US006199830B1

(12) United States Patent
Kiiski

(10) Patent No.: US 6,199,830 B1
(45) Date of Patent: Mar. 13, 2001

(54) CHAIN ELEVATOR

(75) Inventor: Tapani Kiiski, Hyvinkää (FI)

(73) Assignee: KCI Konecranes International PLC, Hyvinkää (FI)

( * ) Notice: Subject to any disclaimer, the term of this patent is extended or adjusted under 35 U.S.C. 154(b) by 0 days.

(21) Appl. No.: 09/534,382

(22) Filed: Mar. 24, 2000

(30) Foreign Application Priority Data

Mar. 26, 1999 (FI) ..... 990681

(51) Int. Cl.[7] ..... B66D 1/30

(52) U.S. Cl. ..... 254/372; 254/221; 474/155; 474/210

(58) Field of Search ..... 254/371, 372, 254/383, 221; 474/210, 155, 144; 74/89.2, 665 GE

(56) References Cited

U.S. PATENT DOCUMENTS

| | | | | |
|---|---|---|---|---|
| 393,491 | * | 11/1888 | Stone | 474/210 |
| 616,936 | * | 1/1899 | Kidd | 474/155 |
| 2,321,702 | * | 6/1943 | Renkin | 474/155 |
| 2,613,546 | * | 10/1952 | Jorgensen | 474/210 |
| 3,362,239 | * | 1/1968 | Kaye et al. | 474/155 |
| 3,415,135 | * | 12/1968 | Royer et al. | 474/155 |
| 4,459,124 | * | 7/1984 | Newton | 474/210 |

FOREIGN PATENT DOCUMENTS

| | | | | |
|---|---|---|---|---|
| 556782 | * | 5/1931 | (DE) | 474/210 |
| 144655 | * | 6/1920 | (GB) | 474/155 |
| 7904559 | * | 5/1931 | (NL) | 474/155 |

* cited by examiner

*Primary Examiner*—Donald P. Walsh
*Assistant Examiner*—Emmanuel M. Marcelo
(74) *Attorney, Agent, or Firm*—Birch, Stewart, Kolasch & Birch, LLP

(57) ABSTRACT

The invention relates to a chain elevator comprising an elevating chain (1) made up of links (2) attached to each other, whereby the planes formed by adjacent links are primarily at a 90° angle in relation to each other; an elevating element (3) having a driven chain gear (7) arranged to it, the elevating chain (1) being led to couple with the driven chain gear from the fixing point (9) of the fixed end (8) of the elevating chain located above the driven chain gear (7); and a driving chain gear (100) located above the driven chain gear (7), the elevating chain being led to couple with the driving chain gear from the driven chain gear (7). The fixing point (9) of the fixed end of the elevating chain is moved aside from the rotating plane (A) of the driving chain gear (100) so that the shaft (7*a*) of the driven chain gear is substantially at a 45° angle in relation to the shaft (100*a*) of the driving chain gear when seen from above or below, the plane formed by every second link (2) of the elevating chain coupled to the driven chain gear (7) being substantially parallel with the shaft (7*a*) of the driven chain gear and every other link being substantially perpendicular in relation to said shaft, and the plane formed by each link (2) of the elevating chain coupled the driving chain gear (100) being substantially at a 45° angle in relation to the shaft (100*a*) of the driving chain gear.

6 Claims, 1 Drawing Sheet

CHAIN ELEVATOR

BACKGROUND OF THE INVENTION

The invention relates to a chain elevator which comprises an elevating chain made up of links attached to each other, whereby the planes formed by adjacent links are primarily at a 90° angle in relation to each other and which chain has a fixed end; an elevating element having a driven chain gear arranged to it, the elevating chain being led to couple with the driven chain gear from the fixing point of the fixed end of the elevating chain located above the driven chain gear in such a manner that the elevating element hangs on the elevating chain; and a driving chain gear located above the driven chain gear, the elevating chain being led to couple with the driving chain gear from the driven chain gear, whereby the plane formed by each elevating chain link in said coupling is substantially at a 45° angle in relation to the shaft of the driving chain gear.

The invention also relates to a chain elevator which comprises an elevating chain made up of links attached to each other, whereby the planes formed by adjacent links are primarily at a 90° angle in relation to each other and which chain has a fixed end; an elevating element having a driven chain gear arranged to it, the elevating chain being led to couple with the driven chain gear from the fixing point of the fixed end of the elevating chain located above the driven chain gear in such a manner that the elevating element hangs on the elevating chain, whereby the plane formed by every second link of the elevating chain in said coupling is substantially parallel with the shaft of the driven chain gear and the plane formed by every other link is substantially perpendicular with said shaft; and a driving chain gear located above the driven chain gear, the elevating chain being led to couple with the driving chain gear from the driven chain gear.

A conventional chain elevator, i.e. the one described last in the above, is one in which every second chain link plane is, when coupled with both the (freely rotating) driven chain gear and the driving chain gear (drive gear), parallel with the shaft of the chain gear and every other chain link perpendicular with it. In this solution, only every second link is capable of transmitting the power of the driving chain gear to the elevating chain.

A more advanced solution, i.e. the one described first in the above, is a 45° chain drive in which the elevating chain runs through the chain gears so that the plane of each link is always at an approximately 45° angle in relation to the chain gear shafts. As compared with the conventional chain drive, the 45° chain drive provides, for instance, the following advantages: all links in the elevating chain participate in power transmission when coupled with the driving chain gear and the polygon effect (i.e. the variation in elevating speed and force caused by the polygon-form of the chain gear) lessens. Thus, a 4-pocket chain gear in a 45° chain drive, for instance, achieves the same properties as an 8-pocket chain gear in a conventional chain drive. Owing to this, it is possible to use smaller chain gears with certain specifications (minimum number of load-bearing pockets and the amount of the polygon effect). Then the load-bearing torque of the driving chain gear, which at the same time is the torque related to this chain gear, becomes smaller. The required transmission ratio of the gear is also smaller.

However, the 45° chain drive also has significant drawbacks, because the forces between the elevating chain and the driven chain gear are extremely disadvantageous for both the chain and the chain gear. Therefore, both wear quickly and in particular when used in a drive which has the same chain length all the time and consequently the same location in the chain runs repeatedly through the driven chain gear. In such a case, there is an actual danger of a chain break.

BRIEF DESCRIPTION OF THE INVENTION

It is an object of the invention to improve the chain elevators described above so as to solve the above problems.

In a 45° chain drive, this object is achieved by a solution of the invention which is characterized in that the fixing point of the fixed end of the elevating chain is moved aside from the rotating plane of the driving chain gear so that the shaft of the driven chain gear is substantially at a 45° angle in relation to the shaft of the driving chain gear in the direction of view defined by the chain section between the driven and the driving chain gear, and that the plane formed by every second link of the elevating chain coupled with the driven chain gear is substantially parallel with the shaft of the driven chain gear and the plane formed by every other link is substantially perpendicular with said shaft.

In a conventional chain drive, this object is achieved by a solution of the invention which is characterized in that the fixing point of the fixed end of the elevating chain is moved aside from the rotating plane of the driving chain gear so that the shaft of the driven chain gear is substantially at a 45° angle in relation to the shaft of the driving chain gear in the direction of view defined by the chain section between the driven and the driving chain gear, and that the plane formed by each elevating chain link coupled with the driving chain gear is substantially at a 45° angle in relation to the driving chain gear.

In the solutions of the invention, the driven chain gear and the passage of the elevating chain through it is implemented as in a conventional chain elevator, in which every second chain link is horizontal in relation to the shaft of the driven chain gear and every other link is perpendicular in relation to it, while the driving chain gear and the passage of the elevating chain through it is as in a 45° chain drive. This way, the chain wears in a different manner and at different places in each chain gear, making the operating life of the chain considerably longer. Thus, changing the location of the fixing point of the fixed end of the elevating chain in the invention makes it possible to combine the conventional and the 45° chain drive and their advantages, thus preserving the considerable advantages of the 45° chain drive's power transmission.

Practical implementation of the chain elevator of the invention is easy and the costs are low, since, in addition to the above-mentioned fixing point re-positioning, the only requirement is that the driven chain gear be one corresponding to that of a conventional chain elevator and the driving chain gear be one corresponding to that of a 45° chain drive. No new components are required.

BRIEF DESCRIPTION OF THE FIGURES

In the following, the invention will be described in greater detail with reference to the attached drawings, in which.

DETAILED DESCRIPTION OF THE INVENTION

Figures 1, 2, 3, 4, 5, 6, 7, 8:
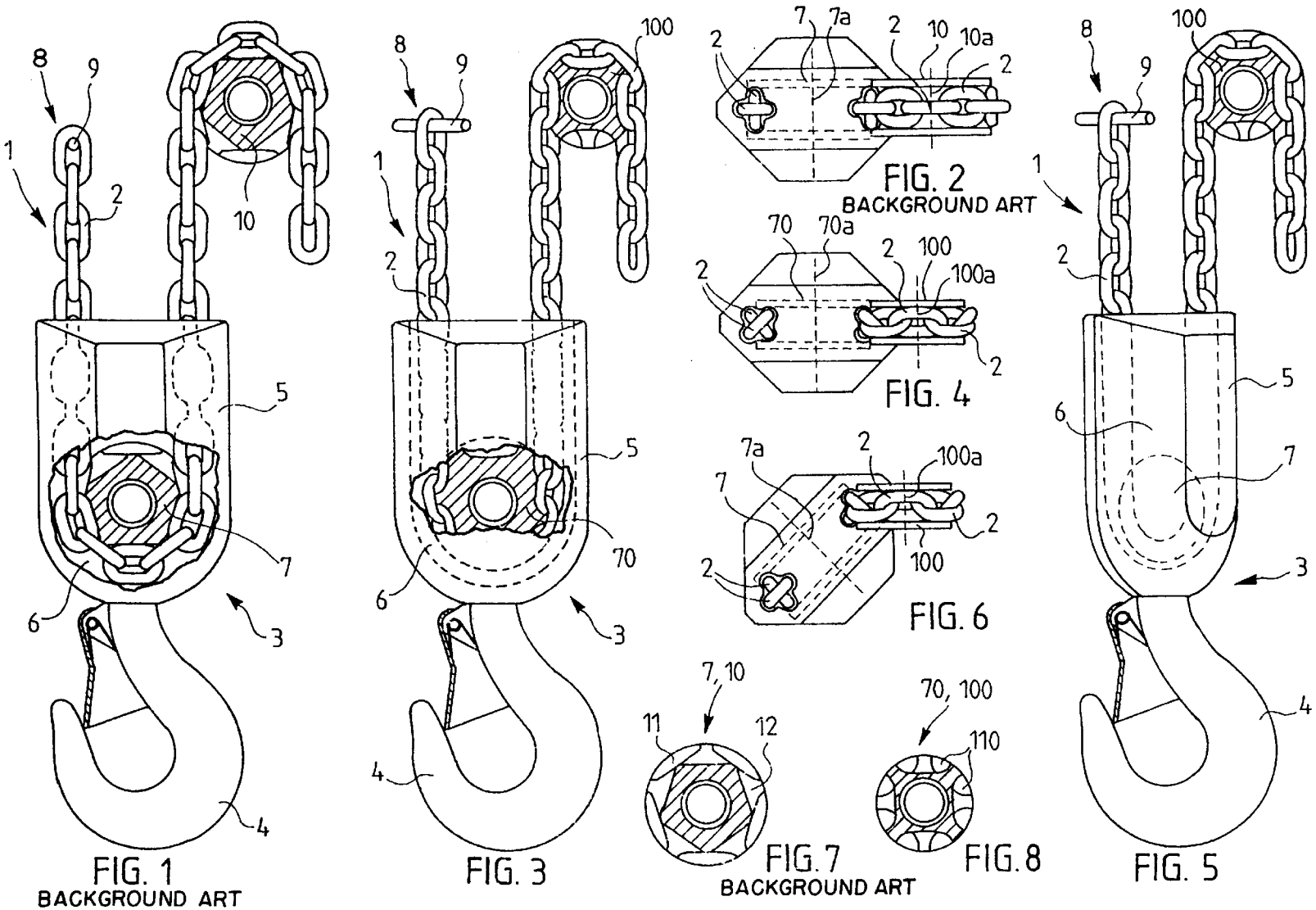
FIG. 1 BACKGROUND ART
FIG. 2 BACKGROUND ART
FIG. 7 BACKGROUND ART
FIG. 1 shows a conventional chain elevator from the side.
FIG. 2 shows a conventional chain elevator from above.
FIG. 3 shows a chain elevator having a 45° chain drive from the side.
FIG. 4 shows a chain elevator having a 45° chain drive from above.
FIG. 5 shows a chain elevator of the invention from the side.
FIG. 6 shows a chain elevator of the invention from above.
FIG. 7 shows a conventional chain gear.
FIG. 8 shows a 45° chain gear.

FIGS. 1 and 2 show a conventional chain elevator which comprises an elevating chain 1 made up of links 2 attached to each other, whereby the planes formed by adjacent links 2 are primarily at a 90° angle in relation to each other; an elevating element 3 which comprises a lifting hook 4 and a related hook casing 5 inside which there is a cavity 6 into which a driven chain gear 7 is mounted, the elevating chain 1 being led to couple with the driven chain gear 7 from the fixing point 9 of the fixed end 8 of the elevating chain 1 located above the driven chain gear 7 in such a manner that the elevating element 3 hangs on the elevating chain 1; and a driving chain gear 10 located above the driven chain gear 7, the elevating chain 1 being led to couple with the driving chain gear from the driven chain gear 7.

In this conventional chain elevator, the plane formed by every second link 2 of the elevating chain 1 coupled with the chain gears 7 and 10 is substantially parallel with the shaft 7*a*, 10*a* of the chain gear 7, 10 being used, and the plane formed by every other link 2 is substantially perpendicular with said shaft.

In a conventional chain gear 7, 10 shown in FIG. 7, only every second elevating chain 1 link 2 (the link parallel with the shaft 7*a*, 10*a*) can transmit power when in the pockets 11, 12 of the chain gear 7, 10.

The chain elevator having a 45° chain gear shown in FIGS. 3 and 4 differs from the conventional chain elevator shown in FIGS. 1 and 2 mainly only in that the plane formed by each elevating chain 1 link 2 coupled with the chain gears 70 and 100 is substantially at a 45° angle in relation to the shafts 70*a*, 100*a* of the chain gears 70, 100.

In the 45° chain gear 70, 100 of FIG. 8, each link 2 of the elevating chain 1 transmits power when in the pockets 110 of the chain gear 70, 100. Another difference with the conventional chain gear 7, 10 is that the chain gear 70, 100 can be made smaller in diameter, which provides the advantages stated above.

The chain elevator of the invention shown in FIGS. 5 and 6 differs from the prior art elevators described above in that the fixing point 9 of the fixed end 8 of the elevating chain 1 is moved aside from the rotating plane A of the driving chain gear 100 so that the shaft 7*a* of the driven chain gear 7 is substantially at a 45° angle in relation to the shaft 100*a* of the driving chain gear 100 in the direction of view defined by the chain section between the driven and the driving chain gear 7, 100 (i.e. when viewing the chain elevator from above or below), that the plane formed by every second link 2 of the elevating chain 1 coupled with the driven chain gear 7 is substantially parallel with the shaft 7*a* of the driven chain gear 7 and the plane formed by every other link 2 is substantially perpendicular with said shaft 7*a*, as in the case of FIGS. 1 and 2, and that the plane formed by each link 2 of the elevating chain 1 coupled with the driving chain gear 100 is substantially at a 45° angle in relation to the shaft 100*a* of the driving chain gear 100, as in the case of FIGS. 3 and 4. In addition, it should be noted that the re-positioning of the fixing point 9 shown in the figure can naturally also be made to the other side of the plane A.

It is advantageous that the chain section between the fixed end 8 of the elevating chain and the driven chain gear is substantially parallel with the chain section between the driven and driving chain gear 7, 100, whereby the forces affecting the chain gears 7, 100 can be made as advantageous (small) as possible.

The above description of the invention is only meant to illustrate the basic idea of the invention. Thus, a person skilled in the art can implement the details of the elevator in many alternative ways within the scope of the attached claims. As for the angles provided, they should be interpreted as approximates, since the essential in this context is that the coupling of the elevating chain with the chain gears occurs substantially in a manner characteristic to each coupling.

What is claimed is:

1. A chain elevator comprising an elevating chain made up of links attached to each other, whereby the planes formed by adjacent links are primarily at a 90° angle in relation to each other, and which chain has a fixed end, an elevating element having a driven chain gear arranged to it, the elevating chain being led to couple with the driven chain gear from a fixing point of the fixed end of the elevating chain located above the driven chain gear in such a manner that the elevating element hangs on the elevating chain, and a driving chain gear located above the driven chain gear, the elevating chain being led to couple with the driving chain gear from the driven chain gear, whereby the plane formed by each elevating chain link in said coupling is substantially at a 45° angle in relation to the shaft of the driving chain gear, wherein the fixing point of the fixed end of the elevating chain is moved aside from the rotating plane of the driving chain gear so that the shaft of the driven chain gear is substantially at a 45° angle in relation to the shaft of the driving chain gear in the direction of view defined by the chain section between the driven and the driving chain gear, and that the plane formed by every second link of the elevating chain coupled with the driven chain gear is substantially parallel with the shaft of the driven chain gear and the plane formed by every other link is substantially perpendicular with said shaft.

2. A chain elevator as claimed in claim 1, wherein the elevating element comprises a lifting hook and a related hook casing inside which there is a cavity into which the driven chain gear is arranged.

3. A chain elevator as claimed in claim 1, wherein the chain section between the fixed end of the elevating chain and the driven chain gear is substantially parallel with the chain section between the driven and driving chain gear.

4. A chain elevator comprising an elevating chain made up of links attached to each other, whereby the planes formed by adjacent links are primarily at a 90° angle in relation to each other, and which chain has a fixed end, an elevating element having a driven chain gear arranged to it, the elevating chain being led to couple with the driven chain gear from a fixing point of the fixed end of the elevating chain located above the driven chain gear in such a manner that the elevating element hangs on the elevating chain, whereby the plane formed by every second link of the elevating chain in said coupling is substantially parallel with the shaft of the driven chain gear and the plane formed by every other link is substantially perpendicular with said shaft, and a driving chain gear located above the driven chain gear, the elevating chain being led to couple with the driving chain gear from the driven chain gear, wherein the fixing point of the fixed end of the elevating chain is moved aside from the rotating plane of the driving chain gear so that the shaft of the driven chain gear is substantially at a 45° angle in relation to the shaft of the driving chain gear in the direction of view defined by the chain section between the driven and the driving chain gear, and that the plane formed by each link of the elevating chain coupled with the driving chain gear is substantially at a 45° angle in relation to the shaft of the driving chain gear.

5. A chain elevator as claimed in claim 4, wherein the elevating element comprises a lifting hook and a related hook casing inside which there is a cavity into which the driven chain gear is arranged.

6. A chain elevator as claimed in claim 4, wherein the chain section between the fixed end of the elevating chain and the driven chain gear is substantially parallel with the chain section between the driven and driving chain gear.

* * * * *